US006186493B1

(12) United States Patent
Toriyama

(10) Patent No.: US 6,186,493 B1
(45) Date of Patent: Feb. 13, 2001

(54) APPARATUS AND METHOD FOR SUPPLYING A PLURALITY OF BOX SHEETS ALONG BELTS AT PREDETERMINED INTERVALS

(75) Inventor: Daigoro Toriyama, Nagareyama (JP)

(73) Assignee: Tanabe Machinery Co., Ltd, Tokyo (JP)

( * ) Notice: Under 35 U.S.C. 154(b), the term of this patent shall be extended for 0 days.

(21) Appl. No.: 09/094,984

(22) Filed: Jun. 15, 1998

(30) Foreign Application Priority Data

Dec. 25, 1997 (JP) ..... 9-366221

(51) Int. Cl.[7] ..... B65H 3/04

(52) U.S. Cl. ..... 271/35; 271/34; 271/4.05; 271/10.06

(58) Field of Search ..... 271/35, 34, 10.06, 271/4.05, 4.06, 4.07, 4.08, 10.07, 10.08

(56) References Cited

U.S. PATENT DOCUMENTS

| | | | | |
|---|---|---|---|---|
| Re. 34,894 | * | 4/1995 | Golicz | 271/6 |
| 2,689,731 | | 9/1954 | Peters | 271/41 |
| 3,738,642 | * | 6/1973 | Blaire | 271/10 |
| 3,894,732 | * | 7/1975 | Muller | 271/10 |
| 3,988,017 | * | 10/1976 | Kyhl | 271/111 |
| 4,363,478 | * | 12/1982 | Tsukasaki | 271/10 |
| 4,395,177 | * | 7/1983 | Seragnoli | 414/130 |
| 4,638,732 | * | 1/1987 | Salazar et al. | 271/258 X |
| 4,844,436 | * | 7/1989 | Jaton | 271/35 X |
| 4,909,499 | * | 3/1990 | O'Brien et al. | 271/10 |
| 4,930,291 | | 6/1990 | Buisseau | 53/458 |
| 5,026,040 | * | 6/1991 | Gilbert | 271/35 |
| 5,092,577 | * | 3/1992 | Schmitz et al. | 271/11 |
| 5,238,143 | * | 8/1993 | Crighton | 271/35 |
| 5,464,202 | * | 11/1995 | Capdeboscq | 271/11 |
| 5,601,282 | * | 2/1997 | Milo et al. | 271/35 |

FOREIGN PATENT DOCUMENTS

| | | | | |
|---|---|---|---|---|
| 36 40 675 | | 6/1988 | (DE) . | |
| 3640675 A1 | * | 6/1988 | (DE) | 271/35 |
| 5-85456 | | 12/1993 | (JP) . | |

OTHER PUBLICATIONS

English translation, Abstract of Germany Patent DE 3640675A1, Feb. 2000.*

* cited by examiner

*Primary Examiner*—Christopher P. Ellis
*Assistant Examiner*—Richard Ridley
(74) *Attorney, Agent, or Firm*—Wenderoth, Lind & Ponack, L.L.P.

(57) ABSTRACT

An apparatus and method for supplying a plurality of box sheets comprising first belts which are movable in a predetermined direction, second belts which are also movable in the predetermined direction of the first belts, a shutter located above at least one of the first belts or the second belts, wherein the shutter is located so as to allow only one of the plurality of box sheets to be supplied beneath the shutter at a time, and a control system for controlling an operation of the second belts, wherein a coefficient of friction between the second belts and the box sheets is stronger than a coefficient of friction between the first belts and the box sheets.

8 Claims, 3 Drawing Sheets

APPARATUS AND METHOD FOR SUPPLYING A PLURALITY OF BOX SHEETS ALONG BELTS AT PREDETERMINED INTERVALS

BACKGROUND OF THE INVENTION

1. Field of the Invention

The present invention relates to the field of box-making machines and methods. Specifically, the present invention provides an apparatus and method for supplying a plurality of box sheets or box sheet blanks along belts at predetermined intervals.

2. Description of the Related Art

A conventional device, which is part of a box-making machine, for supplying a box sheet is operative so as to take one box sheet from multiple box sheets stacked in a pile and feed the box sheet into a process for making a box. A typical device for supplying a box sheet comprises plural supply belts and a shutter placed above the supply belts, wherein the shutter has a gap which allows only one box sheet to be sent at a time, and wherein the box sheets are stacked up against the shutter in a pile which is no taller than a top portion of the shutter. The box sheets are sent past the gap one at a time due to a contact resistance or coefficient of friction between the supply belt and the piled box sheets. An interval between each of the sent box sheets (between an end of a previous box sheet and the tip of a following box sheet) is adjusted by placing sending belts next to the lower reaches of the supply belts, wherein the sending belts operate faster than the supply belts.

However, because the sending belts, placed at the lower reaches of the supply belts, operate faster than the supply belts in the conventional device, if only one side of a box sheet is caught by the sending belts, this one side of the box sheet is pulled into the sending belts at a higher speed than the other side of the box sheet. As a result, the box sheet is supplied to the sending belts at an improper angle.

Therefore, in order to prevent the one side of the box sheet from being pulled at a high speed by the sending belt prior to the other side of the box sheet from being pulled, a box sheet supplying device has been developed which operates the sending belts at the same speed as the supply belts and which adjusts an interval between each of the sent box sheets by lifting up the piled box sheets so as to not contact the supply belts.

However, due to the fact that the box-making machines operate at very high speeds, it is difficult to harmonize the lifting up/putting down movement of the piled box sheets with the speed of the supply belts, thereby making it difficult to adjust the interval between each of the sent box sheets, thus resulting in variances from the prescribed intervals of each of the sent box sheets.

SUMMARY OF THE INVENTION

An object of the present invention is to overcome the above-described problems and to provide an apparatus and method for supplying a plurality of box sheets in which it is easy to adjust an interval between each of the sent box sheets and in which it is easy to fine-tune the interval, thereby providing an apparatus and method which achieves accurate and adjustable intervals between each of the supplied box sheets.

In the present invention, there is provided an apparatus for supplying a plurality of box sheets comprising at least one first belt which is movable in a predetermined direction, and at least one second belt which is movable in the predetermined direction of the at least one first belt, wherein a first coefficient of friction between the plurality of box sheets and the at least one second belt is greater than a second coefficient of friction between the plurality of box sheets and the at least one first belt.

The apparatus further comprises a shutter located above at least one of the at least one first belt or the at least one second belt, wherein the shutter is positioned so as to allow only one of the plurality of box sheets to be supplied beneath the shutter at a time, and a control system for controlling an operation of the at least one second belt. The shutter further comprises a detection means for detecting an edge of the plurality of box sheets.

According to the present invention, as the first coefficient of friction between the plurality of box sheets and the at least one second belt is greater than the second coefficient of friction between the plurality of box sheets and the at least one first belt, the box sheet is not carried and sent away from the shutter when the at least one second belt is not moving, and the box sheets are carried and sent away from the shutter one sheet at a time when the at least one second belt is moving.

Further according to the present invention, it is preferable to provide plural first belts and plural second belts so that the first coefficient of friction between the plurality of box sheets and the second belts is clearly greater than the second coefficient of friction between the plurality of box sheets and the first belts.

The apparatus of the present invention further comprises a first shaft for driving the at least one first belt, rotating means for rotating the first shaft, a second shaft for driving the at least one second belt, and a clutch-brake unit operatively connected to the first and second shafts, wherein the second shaft is rotated with the first shaft when the clutch-brake unit is engaged, wherein the second shaft is not rotated with the first shaft when the clutch-brake unit is released, and wherein the control system controls an operation of the at least one second belt by controlling the clutch-brake unit.

The control system of the present invention further comprises an encoder for detecting the rotation of the first shaft, a counter for counting a number of revolutions of the first shaft based upon the detection of the rotation of the first shaft by the encoder, and a microcomputer for controlling the engaging and releasing of the clutch based upon the number of revolutions counted by the counter.

The apparatus of the present invention further comprises at least one third belt having an end located adjacent to an end of the at least one first belt, wherein the at least one third belt receives the plurality of box sheets after being supplied beneath the shutter, and wherein the at least one third belt moves at a same speed as the at least one first belt.

The present invention further provides a method for supplying a plurality of box sheets comprising the driving of at least one first belt by rotating the first shaft, engaging the clutch-brake unit so as to rotate the second shaft with the first shaft and drive the at least one second belt, and thereby allowing one of the plurality of box sheets to be supplied beneath the shutter. The method further comprises detecting when the one of the plurality of box sheets has completely passed beneath the shutter, releasing the clutch-brake unit, upon the detection that one of the plurality of box sheets has completely passed beneath the shutter, thereby disabling the rotation of the second shaft with the first shaft and disabling the driving of the at least one second belt, thereby preventing any of the plurality of box sheets from being supplied beneath the shutter, and repeating the afore-mentioned steps for a subsequent box sheet.

The detecting step of the method of the present invention further comprises detecting the rotation of the first shaft upon engaging the clutch, and counting a number of revolutions of the first shaft based upon detecting the rotation of the first shaft, wherein the one of the plurality of box sheets is detected to have completely passed beneath the shutter when the number of revolutions counted in the counting step corresponds to a length of the one of the plurality of box sheets.

The method of the present invention further comprises detecting the rotation of the first shaft upon releasing the clutch, and counting a number of revolutions of the first shaft based upon detecting the rotation of the first shaft, wherein the step of engaging the clutch for a subsequent box sheet is performed when the number of revolutions counted in the counting step corresponds to a prescribed interval length desired between the plurality of box sheets to be supplied beneath the shutter.

DETAILED DESCRIPTION OF THE INVENTION

Preferred embodiments of the present invention are described below in detail with reference to the accompanying drawings.

Figure 1:
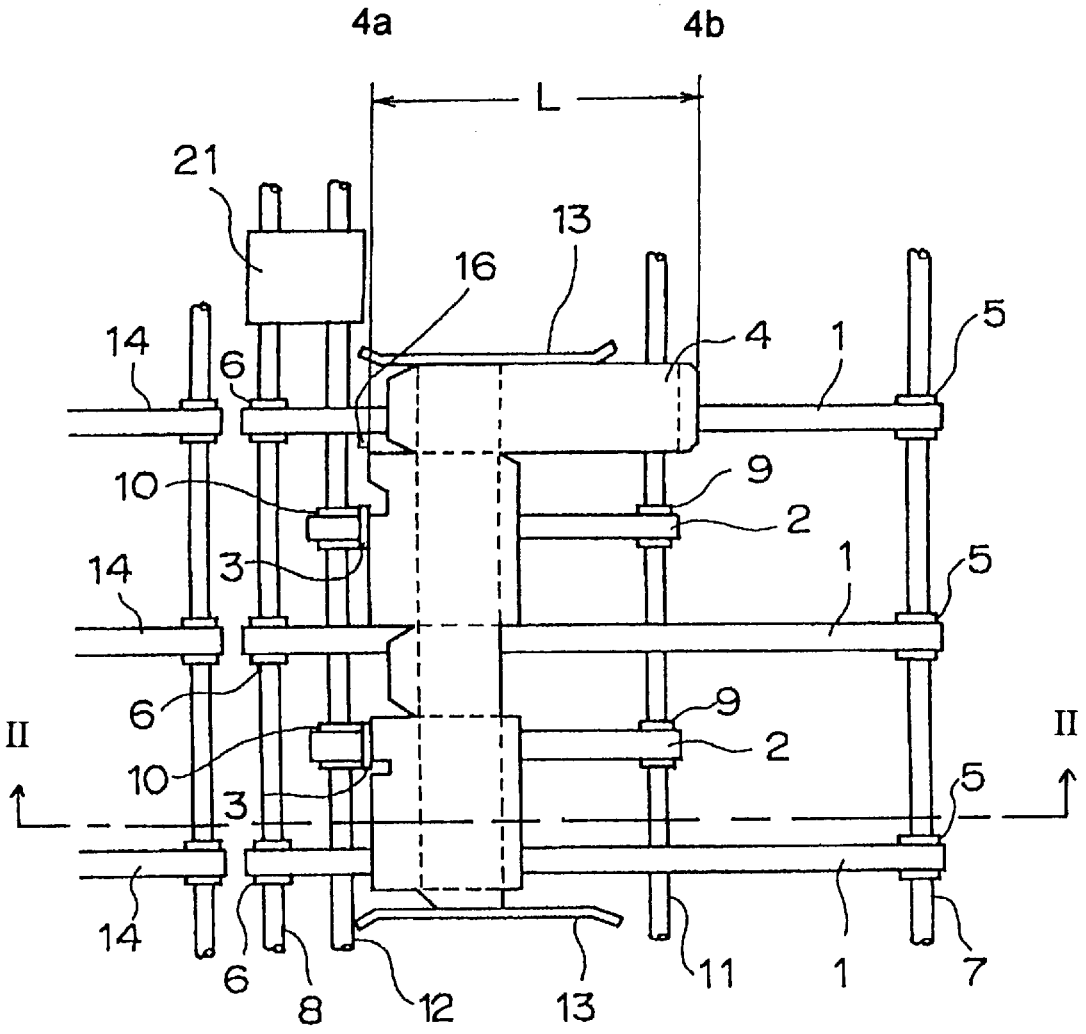
FIG. 1 is a plan view of an apparatus for supplying a plurality of box sheets according to the present invention.
Figure 2:
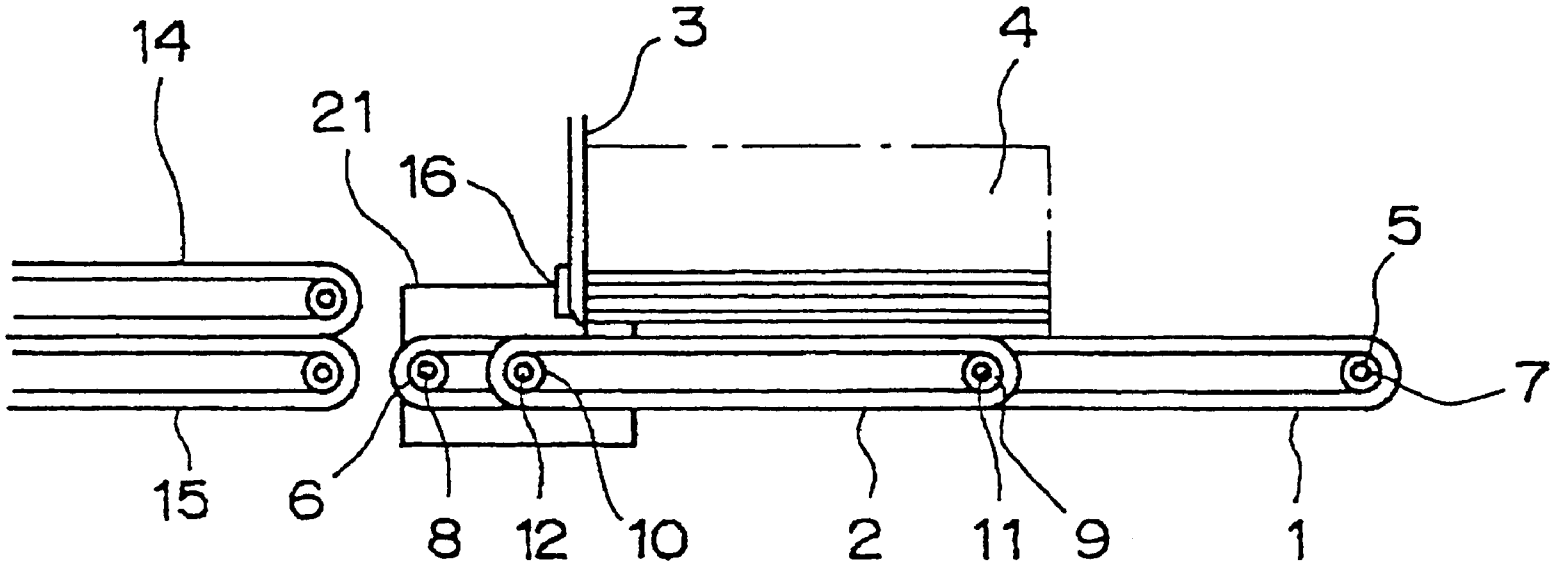
FIG. 2 is a cross-sectional view taken from line II—II of FIG. 1.

FIGS. 1 and 2 show a box sheet supplying apparatus of the present invention. The apparatus for supplying a plurality of box sheets or box sheet blanks of the present embodiment is shown as comprising first belts 1 which are endless, second belts 2 which are also endless and operate in the same direction as the first belts 1, and a shutter 3 having a gap which allows the plurality of box sheets 4 to be sent one sheet at a time. The shutter is located above the first belts 1 and the second belts 2 so that the plurality of box sheets are piled up against the shutter in a pile which is no taller than a top portion of the shutter 3.

As shown in FIG. 1, three first belts 1 are provided in a side by side manner in the present embodiment. Two pulleys 5–6 are provided at both ends of each of the first belts 1. The pulleys 5 provided on the upper reaches of the first belts 1 (right side of FIG. 1) are concentrically mounted along a fixed shaft 7 which is mounted between frames (not described). Each of the pulleys 6 provided on the lower reaches of each of the first belts 1 are fixed on a first shaft 8. The first shaft 8 is built between the frames and is placed at a prescribed interval from the fixed shaft 7. The first shaft 8 is provided so as to be rotated by a rotating means such as a motor for example (not shown). By rotating the first shaft 8, each of the pulleys 6 are rotated and each of the first belts 1 are operated and moved.

The apparatus of the present embodiment provides two second belts 2 placed between each of the first belts 1. Two pulleys 9–10 are provided at both ends of each of the second belts 2. The second belts 2 comprise a material such that a coefficient of friction between the two second belts 2 and the box sheets 4 is stronger than a coefficient of friction between the three first belts 1 and the box sheets 4. The pulley 9 of each of the second belts 2, which are provided at the upper reaches of the second belts 2 and inside the pulley 5 of each of the first belts 1, is concentrically mounted along a fixed shaft 11 which is mounted between the frames. The pulley 10 of each of the second belts 2, which are provided at the lower reaches of the second belts 2 and inside the pulley 6 of each of the first belts 1, is fixed at a second shaft 12 which is mounted between the frames and is located at a prescribed interval from the fixed shaft 11. The second shaft 12 is connected with a clutch-brake unit 21. The clutch-brake unit 21 is further connected with the first shaft 8. Therefore, the second shaft 12 is not rotated with the first shaft 8 when the clutch-brake unit 21 is released, and the second shaft 12 is rotated with the first shaft 8 when the clutch-brake unit 21 is engaged. Therefore, the second belts 2 are not operated or moved when the clutch-brake unit 21 is released. In this case, since the coefficient of friction between the second belts 2 and the box sheets 4 is greater than the coefficient of friction between the first belts 1 and the box sheets 4, the box sheets 4 are not carried and sent away from the shutter 3. On the other hand, the second belts 2 are operated with the rotation of the pulleys 10 when the clutch-brake unit 21 is engaged. In this case, the box sheets 4 are carried and sent away from the shutter 3 one sheet at a time since the second belts 2 are operated and moved in the same direction as the first belts 1.

In the afore-mentioned embodiment, it is desirable that the second belts 2, the shutter 3, the pulleys 9–10, the fixed shaft 11, the second shaft 12, the clutch-brake unit 21, and the like are removably mounted with the frame. In this case, the embodiment can be easily mounted on a box-making machine which does not comprise a mechanism for sending box sheets one sheet at a time. Furthermore, the complicated mechanism of a box-making machine for sending a box sheet can be replaced with the concise structure of the afore-mentioned embodiment of the present invention.

Furthermore, guide boards 13 can be mounted adjacent to the two outer positioned first belts 1 so as to guide both sides of the box sheets 4.

Three pairs of endless sending belts 14–15 are provided at the lower reaches of the first belts 1. As shown in FIG. 2, each pair of sending belts 14–15 are set up so as to face each other. These sending belts 14–15 are operated at the same speed as the first belts 1. The sending belts 14–15 can send the box sheets 4 supplied from the first belts 1 by catching the box sheets 4 in between the sending belts 14–15.

A detection means such as an optical sensor 16, for example, can also be mounted on the shutter 3 so as to detect the edge or tip, and the existence of the box sheets 4.

Figure 3:
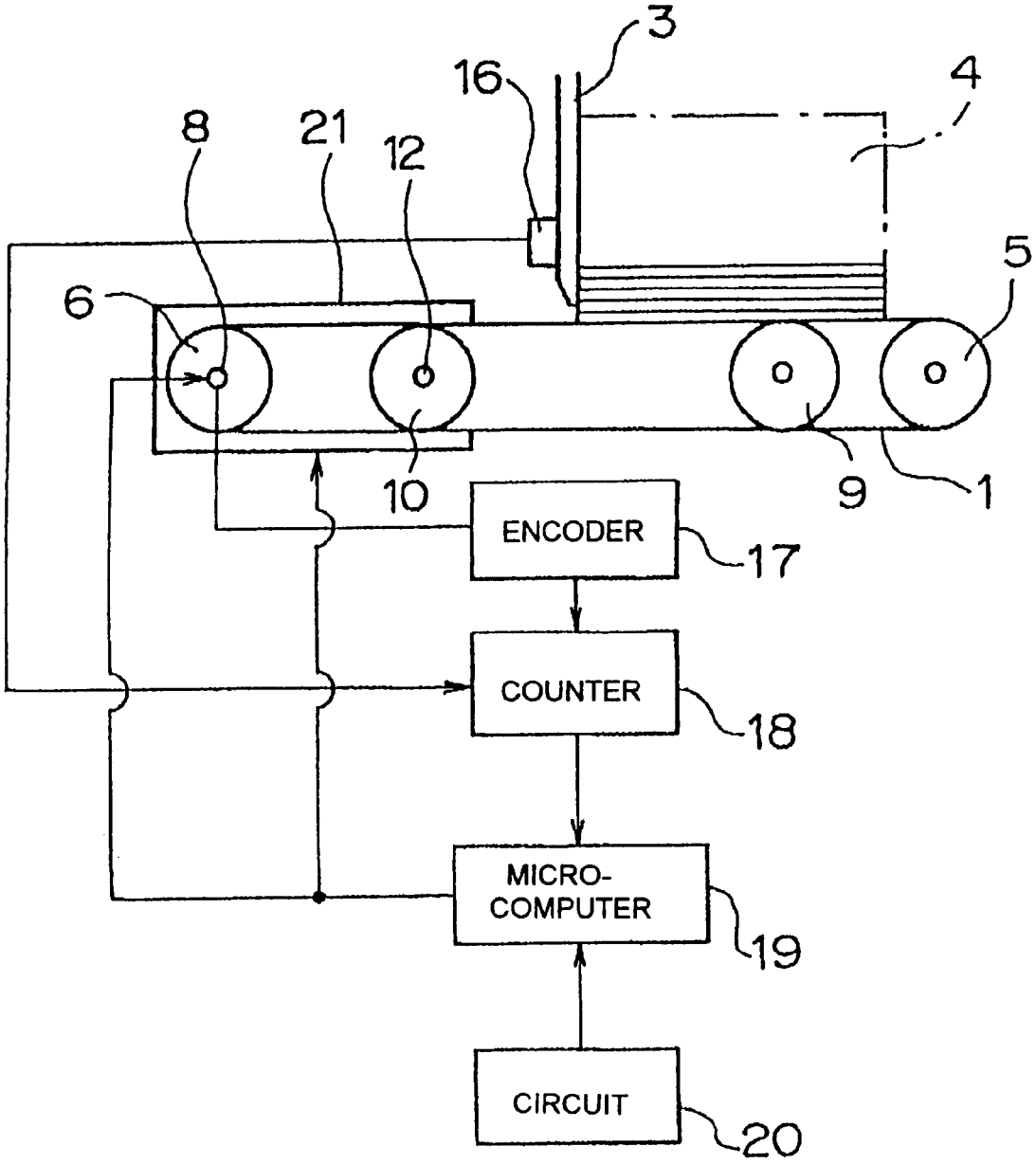
FIG. 3 is a schematic illustration of a control system according to the present invention.

A control system of the apparatus and method for supplying the plurality of box sheets is described next referring to FIG. 3. The control system comprises an encoder 17 which detects the number of revolutions of the first shaft 8, a counter 18 which counts the number of revolutions of the first shaft 8 detected by the encoder 17, a microcomputer 19, and a circuit 20 which sets up the number of intervals between each of the box sheets sent one at a time.

The encoder 17 is set up with an end of the first shaft 8 and is connected to the counter 18. The optical sensor 16 is also connected to the counter 18. The counter 18 and the circuit 20 are connected to the microcomputer 19. The microcomputer 19 is connected to the clutch-brake unit 21 and controls operation of the clutch-brake unit 21.

Operation of the control system is described next.

First, a length L between the tip 4*a* and the end 4*b* of the box sheet 4 (as depicted in FIG. 1) is inputted into the circuit 30 and a variable interval length between each of the sent box sheets 4 (between the end 4*b* of the preceding box sheet 4 and the tip 4*a* of a following box sheet 4) can be inputted into the circuit 20.

Next, the first belts 1 are operated and moved through the rotation of the first shaft 8 and pulleys 6 which are rotated by a rotating means such as an electric motor for example (not described). Concurrently with the operation of the first belt 1, the sending belts 14–15 are operated by the electric motor at the same speed as the first belts 1. At this time, since the clutch-brake unit 21 is released, the second shaft 12 is not driven and, thus, the second belts 2 are not operated. In this case, since the coefficient of friction between the stopped two second belts 2 and the piled box sheets 4 is stronger than a coefficient of friction between the three operated first belts 1 and the piled box sheets 4, the box sheets 4 are not carried and sent away from the lower portion of the shutter 3.

After the prescribed time, the clutch-brake unit 21 is engaged by accepting a signal from the microcomputer 19. The second shaft 12 is then rotated with the first shaft 8 due to the engagement of the clutch-brake unit 21. As a result, the second belts 2 are operated through the rotation of the pulleys 10 by the rotation of the second shaft 12. Since the second belts 2 are now operated and moved, the box sheets 4 are sent away from the lower portion of the shutter 3 by operation of the first belts 1 and the second belts 2 due to the fact that the coefficient of friction between the operated two second belts 2 and the piled box sheets 4 is stronger than a coefficient of friction between the three operated first belts 1 and the piled box sheets 4.

When the box sheet 4 passes through the shutter 3, the optical sensor 16 detects a tip of the box sheet 4. When the tip of the box sheet 4 is detected, a signal is sent from the optical sensor 16 to the counter 18. Then, the counter 18 counts the number of revolutions of the first shaft 8 based on a signal of the encoder 17 from "0". At the same time, the signal sent from the optical sensor 16 to the counter 18 is cut off. When the counter 18 reaches a number corresponding to the number L of the length of the box sheet 4 which was previously inputted to the circuit 20, a signal is sent from the microcomputer 19 to the clutch-brake unit 21 for releasing the clutch-brake unit 21. Accordingly, the moving operation of the second belts 2 is stopped. In this case, the output and movement of a following box sheet 4 is stopped since the coefficient of friction between the two stop second belts 2 and the piled box sheets 4 is stronger than the coefficient of friction between the three operated first belts 1 and the piled box sheets 4. At the same time, the signal transmission between from the optical sensor 16 to the counter 18 is resumed.

The counter 18 then counts the number of revolutions of the first shaft 8 based on the signal of the encoder 17 from "0". When a number corresponding to the prescribed interval length between each of the sent box sheets 4, which was previously inputted to the circuit 20, is counted by the counter 18, the clutch-brake unit 21 is engaged and the second belts 2 begin to be operated, and the above-mentioned control operation of the apparatus of the present invention is repeated. The box sheet 4, which is sent from the shutter 3, is then sent for further processing through the sending belts 14–15. Although the operation of the second belts 2 have been described as being controlled by the clutch-brake unit 21 in the afore-mentioned embodiment, this operation can be controlled by other methods such as by using a microcomputer or the like.

The present invention being thus described, it will be obvious that the same may be varied in many ways. Such variations are not to be regarded as being a departure from the spirit and scope of the present invention, and all such modifications as would be obvious to one skilled in the art are intended to be included within the scope of the present invention as defined by the following claims.

What is claimed is:

1. An apparatus for supplying a plurality of box sheets, said apparatus comprising:

at least one first belt which is movable in a predetermined direction;

at least one second belt which is movable in the predetermined direction of said at least one first belt, wherein a first coefficient of friction between the plurality of box sheets and said at least one second belt is greater than a second coefficient of friction between the plurality of box sheets and said at least one first belt so that the box sheets are not carried and sent away from the shutter when said at least one second belt is not moving, and the box sheets are carried and sent away from the shutter one sheet at a time when said at least one second belt is moving;

a shutter located above at least one of said at least one first belt or said at least one second belt so that only one of the plurality of box sheets can be supplied beneath the shutter at a time; and a control system for controlling an operation of said at least one second belt.

2. An apparatus as claimed in claim 1, wherein said shutter further comprises a detection means for detecting an edge of the plurality of box sheets.

3. An apparatus as claimed in claim 1, said apparatus further comprising:

at least one third belt having an end located adjacent to an end of said at least one first belt, wherein said at least one third belt receives the plurality of box sheets after being supplied beneath said shutter, and wherein said at least one third belt moves at a same speed as said at least one first belt.

4. An apparatus as claimed in claim 1, said apparatus further comprising:

a first shaft for driving said at least one first belt;

a rotating means for rotating said first shaft;

a second shaft for driving said at least one second belt; and a clutch operatively connected to said first and second shafts, wherein said second shaft is rotated with said first shaft when said clutch unit is engaged, and wherein said second shaft is not rotated with said first shaft when said clutch is released; and wherein said control system controls an operation of said at least one second belt by controlling said clutch unit.

5. An apparatus as claimed in claim 4, wherein said control system further comprises:

an encoder for detecting the rotation of said first shaft;

a counter for counting a number of revolutions of said first shaft based upon the detection of the rotation of said first shaft by said encoder; and a microcomputer for controlling the engaging and releasing of said clutch based upon the number of revolutions counted by said counter.

6. A method for supplying a plurality of box sheets along belts which are stacked up in a pile located against a shutter, wherein a clutch operatively connects a first shaft with a second shaft and wherein the first shaft is operative so as to drive at least one first belt and the second shaft is operative so as to drive at least one second belt, said method comprising:

providing the at least one second belt to have a first coefficient of friction with the plurality of box sheets and providing the at least one first belt to have a second coefficient of friction with the plurality of box sheets such that the first coefficient of friction between the plurality of box sheets and the at least one second belt is greater than the second coefficient of friction between the plurality of box sheets and the at least one first belt so that the box sheets are not carried and sent away from the shutter when the at least one second belt is not moving, and the box sheets are carried and sent away from the shutter one sheet at a time when the at least one second belt is moving;

driving the at least one first belt by rotating the first shaft;

engaging the clutch so as to rotate the second shaft with the first shaft and drive the at least one second belt, and thereby allowing one of the plurality of box sheets to be supplied beneath the shutter;

detecting when the one of the plurality of box sheets has completely passed beneath the shutter;

releasing the clutch, upon the detection that the one of the plurality of box sheets has completely passed beneath the shutter, disabling rotation of the second shaft with the first shaft and disabling the driving of the at least one second belt, and thereby preventing another one of the plurality of box sheets from being supplied beneath the shutter; and repeating said driving, engaging, detecting, and releasing steps for a subsequent box sheet.

7. A method as claimed in claim 6, wherein said detecting step further comprises:

detecting the rotation of the first shaft upon engaging the clutch; and counting a number of revolutions of the first shaft based upon said detecting the rotation of the first shaft;

wherein the one of the plurality of box sheets is detected to have completely passed beneath the shutter when the number of revolutions counted in said counting step corresponds to a length of the one of the plurality of box sheets.

8. A method as claimed in claim 6, said method further comprising:

detecting the rotation of the first shaft upon releasing the clutch; and counting a number of revolutions of the first shaft based upon said detecting the rotation of the first shaft;

wherein the step of engaging the clutch for a subsequent box sheet is performed when the number of revolutions counted in said counting step corresponds to a prescribed interval length desired between the plurality of box sheets to be supplied beneath the shutter.

* * * * *